United States Patent [19]

Prillieux et al.

[11] 4,023,980

[45] May 17, 1977

[54] BLENDS OF HYDROGENATED OLIGOMERS OF CYCLOPENTADIENES AND PARAFFINIC OILS

[75] Inventors: Marcel Prillieux; Marcel Robert; Robert Tirtiaux, all of Mont-Saint-Aignan, France

[73] Assignee: Exxon Research and Engineering Company, Linden, N.J.

[22] Filed: July 11, 1975

[21] Appl. No.: 595,237

[30] Foreign Application Priority Data

July 17, 1974 France ..... 74.24784
Jan. 3, 1975 United Kingdom ..... 161/75

[52] U.S. Cl. ..... 106/285; 252/59; 252/73

[51] Int. Cl.[2] ..... C09D 3/00

[58] Field of Search ..... 106/285; 260/80 R, 82, 260/85.3 R, 85.3 C, 666 PY; 252/59, 73

[56] References Cited

UNITED STATES PATENTS

| | | | |
|---|---|---|---|
| 2,734,031 | 2/1956 | McNaughtan | 252/59 X |
| 3,411,369 | 11/1968 | Hammann et al. | 74/200 |
| 3,701,812 | 10/1972 | Gebhart, Jr. et al. | 260/666 PY |
| 3,887,633 | 6/1975 | Go et al. | 252/59 X |

*Primary Examiner*—J. Ziegler
*Attorney, Agent, or Firm*—Frank T. Johmann

[57] ABSTRACT

Blends of paraffinic oils and hydrogenated polycyclopentadiene or polymethylcyclopentadiene.

6 Claims, No Drawings

BLENDS OF HYDROGENATED OLIGOMERS OF CYCLOPENTADIENES AND PARAFFINIC OILS

The invention relates to liquids based on paraffinic oils that have improved properties as oils for use in hydraulic mechanical transmission systems such as hydraulic shock absorbers and also have improved properties as electrical oils.

Most oils contain aromatic, naphthenic and paraffinic carbon atoms and within this specification the term paraffinic oil is used to describe oils whose infra red analysis shows them to contain more than 55% paraffinic carbon atoms.

For a liquid to be useful as a hydraulic fluid it should possess excellent stability, a rather high boiling point, a freezing point that is as low as possible, a high viscosity index, and good lubricating properties. Hydraulic transmission systems as a rule incorporated sections, in particular sealing joints, made with elastomers and it is therefore important that the fluid be virtually inert in relation to such elastomers. The fluid must not impair the mechanical properties of these materials nor must if cause excessive swelling or shrinkage although slight swelling is desirable.

Hydraulic fluids based on mineral oil have been used. The base oil is made by refining a crude paraffinic petroleum distillate. This distillate is selected from the range of distillation of lubricating oils. To obtain the required stability and viscosity index, it is necessary to eliminate as far as possible the aromatic, heteroaromatic and naphthenic constituents of the distillate. This is done by extracting them with a selective solvent, under rather stringent conditions of extraction. However although these refined mineral oils, with paraffinic tendency, possess excellent stability and a high viscosity index, they do not produce the slight swelling which is desirable for the sealing properties of the elastomer joints.

In one aspect the present invention overcomes this drawback and provides a predominantly paraffinic oil that has improved properties as a hydraulic fluid.

Naphthenic oils, that is oils containing a high proportion, generally above 50% of aromatic and naphthenic carbon atoms, have been readily available and widely used, as for example electrical oils. Naphthenic oils are however becoming more scarce and are being replaced by paraffinic oils which have a higher proportion of paraffinic carbon atoms. These oils are however less suitable for electrical applications where they have high pour points (the pour point of an oil being the lowest temperature at which it can readily be poured) as determined by ASTM- D97. An aim of the present invention is therefore to provide a predominantly paraffinic oil that may be used in applications in which naphthenic oils have traditionally been used such as electrical oils and cutting oils.

We have found that the addition of a hydrogenated oligomer of cyclopentadiene or methycyclopentadiences to paraffinic oils increases their swelling power and lowers their pour points thus rending them useful as hydraulic fluids.

The present invention therefore provides a blend comprising from 40% to 99% by weight of a paraffinic oil and from 1% to 60% preferably 1 to 50%by weight of a tetrahydrogenated oilgomer of cyclopentadiene or a methyl cyclopentadiene.

The paraffinic oil may be a synthetic oil or a mineral oil and the choice of the paraffinic oil will depend upon the use to which the oil is to be put as will the preferred relative proportions of the paraffinic oil and the tetrahydrogenated oligomer. For example, where the blend is to be used as a hydraulic fluid we find that an oil having a viscosity between 2 and 30 centistokes at 37.8° C and a viscosity index above 100 is particularly suitable.

Where such an oil is synthetic it may conveniently be prepared by oligomerising an olefine such as propylene, isobutylene and n-butenes; preferably propylene in the presence of a Friedel Crafts catalyst at a temperature in the range −10° C to 80° C and hydrogenating the oligomer so obtained. Particularly suitable synthetic oils are obtained by oligomerising propylene using trace water and boron trifluoride as catalyst at a temperature in the range 20°to 80° C. These defined oligomers may then be hydrogenated by conventional techniques until their Bromine number is less than 1 to produce highly paraffinic oils which when blended with the tetrahydrogenated oligomers of cyclopentadiene or methylcylopentadiene yield fluids having particularly good swelling characteristics with elastomers, including polyurethane elastomers. In this particular embodiment we prefer to use blends containing from 3 to 10%, preferably from 5 to 8% by weight of the tetrahydrogenated oligomer.

The hydrogenated oligomer of cyclopentadiene or a methylcyclopentadiene used in the blend has for preference a viscosity lower than 100 cSt, or better still, less than 50 l cSt at 37.8° C. We prefer to use the tetrahydrogenated derivative of a dimer, a trimer, a tetramer, a pentamer or a mixture of these oligomers. For preference, a mixture is used whose constituents have varying degrees of condensation; and the mixture may contain a certain proportion of heavier constituents than the tetrahydrogenated pentamer. The oligomer can have been obtained from cyclopentadiene, or from methylcyclopentadienes, or from a mixture of hydrocarbons containing different monomers.

The hydrogenated oligomer can be prepared by any of the known processes. For example one may oligomerise or polymerise the monomers or dimers, hydrogeneate the resultant oligomer or polymer, and isolate the fraction of hydrogenated oligomer having the desired characteristics, preferably by distillation. This preparation can be effected from a steamcracking naphtha fraction containing monomers or dimers of cyclopentadiene, or methylcyclopentadienes. The oligomerisation or polymerisation reaction can be effected at low temperature, for instance at a temperature of less than 30° C, in the presence of appropriate catalysts. It is also possible to oligomerise or polymerise the monomers or dimers, without catalyst, by keeping them at a temperature of 200°to 300° C in the autoclave. Hydrogenation can be performed by all appropriate means enabling the double bonds of the polymerized product to be saturated.

In an example of a preferred method for making the hydrogenated oligomer a fraction of steamcracked naphtha is used whose boiling rang is between 80°and 200° C, or better still is from 80°to 175° C. Such a naphtha generally contains high proportions of methylcyclopentadienes and dimers of cyclopentadienes and methylcyclopentadienes. This naphtha is kept in the autoclave at a sufficiently high temperature, e.g. 200°to 300° C for preference between 250°and 300° C and for a sufficient time to polymerise the monomers and dimers initially present. A resisdence time of 2 to 3 hours, at a temperature of 250°to 270° C and at a pressure of 12 to 15 bars is usually sufficient. A very viscous polymer is obtained which may be diluted with a hydrocarbon solvent, for example one boiling between 150°and 200° C, so as to be able to effect hydrogenation without being hampered by the viscosity of the polymer. It is possible to effect hydrogenation in contact with a nickel, nickel molybdate or nickel tungstate catalyst. The conditions of temperature, pressure and time of contact are such that a product is obtained which preferably has a bromine number of nil, or in any case less then 2. The hydrogenation product is fractionated by distilling so as to separate the oligomer having the desired viscosity. A fraction is thus retained whose distiling rang is between 170°and 400° C, or for preference between 190°and 380+ C (calculated temperatures corresponding to distillation at atmospheric pressure).

A blend of the present invention of the paraffinic mineral oil with the hydrogenated oligomer may be prepared by simple mixing of the components in the desired proportions depending upon the use for the oil.

It is usually desirable for an elastomer that is used with hydraulic fluids to undergo an increase in volume of 1 to 4% compared with the initial volume when plunged in oil at a temperature of 130°to 150° C for several days. To obtain this result the respective proportions of the oligomer and the paraffinic oil depend to a certain extent on the particular characteristics of the latter. It is possible to use 1 to 20% by weight of the hydrogenated oligomer, compared with the weight of the final composition although in most cases between 2 and 10% of the final composition is sufficient. The technician will have no difficulty in determining, by a few preliminary tests, the proportion of oligomer suited to a particular case.

For an oil to act as an electrical oil, for example in transmission and switch gear, it is important that the oil have good oxidative stability and low temperature pourability combined with a sufficiently high flash point. For example it is preferred that the oil have a flash point above 150° C, a viscosity below 40 centistokes at 25° C and a pour below −30° C, preferably below −45° C. Whilst many naphthenic oils have a sufficiently low pour point this is not the case with many paraffinic oils. However, we have found that be blending the tetrahydrogenated oligomers of cyclopentadiene or a methylcyclopentadiene with the paraffinic oil a sufficiently low pour point may be obtained. Furthermore, this may be achieved without taking the paraffinic oil outside the other specification set for electrical oils. Where the blends are to be used to electrical oils we prefer that they contain from 20% to 60%, for cost reasons preferably 20% to 40% by weight of the tetrahydrogenated oligomer. The paraffinic oil may be a mineral or a synthetic oil.

We have also found that the blends of the present invention are more easily emulsifiable than pure paraffinic oils. Since paraffinic oils are now becoming more plentiful than naphthenic oils, it is desirable to use paraffinic oils in oil in water emulsions. Unforunately paraffinic oils cannot be emulsified using the emulsifying agents traditionally used with naphthenic oils but we have found that if a tetrahydrogenated oligommer of cyclopentadiene or a methylcyclopentadiene is added to the paraffinic oil it may then be emulsified using emulsifier systems conventionally used for naphthenic oils. This improvement however is slight and applies mainly to oils of medium paraffinic character. Typcial emulsifiable oils comprise 70% to ;b 90% by weight of the blend of the oil of medium paraffinic character and the oligomer with from 10% to 30% of an emulsifier. 5% of these emulsifiable oils may then be combined with 95% by weight of water to give the metal working lubricant. Examples of suitable emulsifiers are the alkylaryl sulphonates particularly the mixtures of sulphonates of different molecular weights described in our copending application Ser. No. 557,396 filed Mar. 11, 1975. Highly paraffinic oils may need additional treatment.

Most oils contain other suitable additives to give them desired properties. For example, a hydraulic fluid may include an additive improving the viscosity index, an additive for lowering the pour point, an extreme-pressure additive, an anti-wear additive, an oxidation-inhibitor etc. Electrical oils may also contain oxidation-inhibitors.

The invention therefore relates to the blends and to the use of these blends particularly as hydraulic fluids and electrical oils. The invention is illustrated but in no way limited by reference to the following examples

EXAMPLE 1

A refined mineral oil with paraffinic character, characterised by a viscosity index of 105, a viscosity at 37.8° C of 23 cSt and a specific gravity of 0.867 and whose infra red analysis showed 7% aromatic carbon atoms, 28% naphthenic carbon atoms and 65% paraffinic carbon atoms was found to have insufficient swelling power in relation to certain elastomers when used as a hydraulic fluid. For example a sample of BUNA N rubber (commercial name denoting a copolymer of butadiene and acrylic nitrile), immersed in the mineral oil for 7 days at 149° C underwent an increase in volume of 0.7% compared with its initial volume (test described in the standard ASTM D-471), while the requirement was for an oil producing a swelling of 1 to 4%.

A mixture was prepared according to the invention of 96% by weight of mineral oil and 4% by weight of the tetrahdyrogenated derivative of an oligomer of cyclopentadiene an methylcyclopentadienes. The composition thus obtained causes BUNA N to swell to 1.8% by volume. (Test ASTM D-471).

The hydrogenated oligomer had been prepared from a fraction of naphtha obtained by steamcracking and distilling from 80°to 175° C which contained approximately 60% dimers of cyclopentadiene and methyl cyclopenetadienes, the remainder being mainly of aromatic hydrocarbons. 170 kg of this naphtha fraction were placed in the autoclave, heated in 2 hours to 260° C and then kept for 2 hours at that temperature.

The contents of the autoclave were then reduced by distilling until 100 kg residue were obtained. This residue was a resinous substance, very dark brown in colour, whose bromine number was 60. It was treated with 500 kg of a hydrocarbon solvent distilling from 150°to 180° C, and the solution obtained was hydrogenated.

Hydrogenation was preformed by a nickel and tungsten-based catalyst at 240° C and 60 bars, until the bromine number of the product was zero.

The hydrogenation product was finally distilled so as to separate the solvent, 40 kg, of a hydrogenated oligomer distilling from 280°to 380° C and 60 kg residue.

The latter was a pale resin whose softening point (ball and ring) was 105° C.

The hydrogenated oligomer (fraction distilling from 180°and 380° C) thus obtained was an oil having the following characteristics:

| | |
|---|---|
| Density at 15° C | 1.019 |
| Refractive index at 20° C | 1.529 |
| Viscosity at 37.8° C | 80.5 cSt |
| Viscosity at 99° C | 7.2 cSt |
| Flash point (Cleveland) | 142° C |
| Freezing Point | −12° C |

EXAMPLE 2

A highly paraffinic basic oil for hydraulic fluids was prepared by oligomerising propylene in a stirred reactor held at 70° C. Propylene was brought into contact with 0.5% by weight of water and 0.6% by weight of anhydrous boron trifluoride, at a pressure of 20 bars, and the average time in the reactor was half an hour. On leaving the reactor, the mixture was expanded from 20 to 1 bar. This expansion brought about the evaporation of propane and boron trifluroide, which were eliminated and the liquid obtained washed with dilute-soda solution.

The yield of oligomer in relation to the weight of propylene used exceeded 99.5% and its characteristics were as follows:

| | |
|---|---|
| Viscosity at 37.8° C | 5.5 cSt |
| Flash point in open vessel (Cleveland) | 95° C |
| Mean molecular mass | 265 |

This oligomer was fractioned by distilling to isolate the fraction having the desired viscosity and flash point. To do so, three fractions were separated, a first fraction (7% by volume), a mid fraction (79% by volume) and residue (14% by volume).

The mid fraction (79% by volume) had the required characteristics, viz.

| | |
|---|---|
| Viscosity at 37.8° C | 4.8 cSt |
| Flash point in open vessel (Cleveland) | 110° C |
| Mean molecular mass | 260 |

This fraction was then hydrogenated on a catalyst based on nickel and cobalt at a temperature of 180° C, the hydrogen pressure being 18 bars and the spatial speed 0.25 h. The oil (A) which was obtained with the yield of 79% by weight in relation to the weight of propylene used had the following characteristics:

| | |
|---|---|
| Viscosity at 37.8° C | 4.9 cSt |
| Viscosity at 99° C | 1.5 cSt |
| Density at 15° C | 0.806 |
| Freezing point | −60° C |
| Cleveland flash point | 110° C |
| Bromine number | 0.2 |
| Aromatic hydrocarbons | 0.2% by weight |
| Distillation (ASTM method D-86): | |
| Volume distilled (%) | Temperatures (° C) |
| Initial point | 237 |
| 10 | 249 |
| 50 | 278 |
| 90 | 314 |
| Final Point | 326 |

The composition of the oil, determined by mass spectrometry, was as follows:

| | Oil A |
|---|---|
| Isoparaffins | 99.7% |
| Cycloparaffins | 0.1% |
| Aromatics | 0.2% |

When a sample of polyurethene rubber was immersed in this oil at 130° C, for 20 days, its volume dropped by 6.9%.

The oil A described above was mixed with the tetrahydrogenated cyclopentadiene oligomer whose preparation is described in Example 1.

Two mixtures were then prepared, one with 93% of the paraffinic oil and 7% of the tetrahydrogenated cyclopentadiene oligomer the other with 86% of the paraffinic oil and 14% of the tetrahydrogenated cyclopentadiene oligomer. These proportions are expressed by volume.

A sample of polyurethane rubber was immersed in these mixtures at 130° C for 20 days. The mechanical characteristics of the samples were measured before and after each test, and the variation of each characteristic was calculated.

The following results were obtained:

| Oil blend tested | 93% 7% | 86% 14% |
|---|---|---|
| Relative variation (%): | | |
| of the module at 100% | −86 | −84 |
| of the module at 300% | −79 | −79 |
| of the breaking load | −85 | −83 |
| of the volume | +2.2 ± 0.5 | +2.7 ± 0.5 |

EXAMPLE 3

The effect of the presence of the tetrahydrogenated cyclopentadiene oligomer on the pour point of a mineral paraffinic oil containing 7% aromatic carbon atom, 28% naphthenic and 65% paraffinic carbon atoms was determined by measuring the pour point of various blends.

The pour point was measured according to test ASTM-D97 and the results were as follows:

| Amount of Hydrogenated Cyclopentadiene % | Paraffinic Oil (Stanco Base) % | Pour Point ° C |
|---|---|---|
| 50 | 40 | −54 |
| 40 | 60 | −39 |
| 0 | 100 | −27 |

The International Electrical Committee Standards require that an electrical oil have a pour point below −30° C and thus the above table shows that this is achieved with a blend of the hydrogenated oligomer although the test is not satisfied by the Paraffinic oil alone.

We claim:

1. A blend comprising from 40% to 99% by weight of a paraffinic oil having a viscosity between 2 and 30 centistokes at 37.8° C and selected from the group consisting of paraffinic mineral oils and synthetic oils made by oligomerizing in the presence of a Friedel Crafts catalyst and olefin selected from the group consisting of propylene, isobutylene and n-butene followed by hydrogenating the oligomer; and from 1% to 60% by weight of a hydrogenated oligomer fraction from a distilling range of 170°–400° C, having a viscosity of less than 100 centistrokes at 37.8° C, prepared by hydrogenating oligomers of cyclopentadiene or a methyl cyclopentadiene.

2. A blend according to claim 1, in which the paraffinic oil is said mineral oil.

3. A blend according to claim 1, in which the paraffinic oil is said synthetic oil made by oligomerizing propylene.

4. A blend according to claim 1, in which said hydrogenated oligomer is a tetrahydrogenated oligomer of cyclopentadiene or a methyl cyclopentadiene, having a viscosity lower than 50 centistokes at 37.7° C.

5. A blend according to claim 3, useful as an electrical oil having a pour point below −30° C and containing from 20% to 60% of the tetrahydrogenated oligomer of cyclopentadiene or methyl cyclopentadiene.

6. A blend according to claim 1, useful as a hydraulic fluid and having rubber seal swelling properties and comprising 2 to 10 wt. % of the tetrahydrogenated oligomer of cyclopentadiene or methyl cyclopentadiene.

* * * * *